US007683549B2

(12) United States Patent
Lehmann

(10) Patent No.: US 7,683,549 B2
(45) Date of Patent: Mar. 23, 2010

(54) METAL HALIDE LAMP WITH FILL COMPRISING LEAD HALIDE

(75) Inventor: Teja Lehmann, Falkensee (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 710 days.

(21) Appl. No.: 11/444,443

(22) Filed: Jun. 1, 2006

(65) Prior Publication Data

US 2006/0273726 A1 Dec. 7, 2006

(30) Foreign Application Priority Data

Jun. 2, 2005 (DE) ..... 10 2005 025 418

(51) Int. Cl.
*H01J 17/20* (2006.01)
*H01J 61/20* (2006.01)

(52) U.S. Cl. ..... 313/640; 313/637; 313/638; 313/639; 313/641; 313/643

(58) Field of Classification Search ..... 313/637–643
See application file for complete search history.

(56) References Cited

U.S. PATENT DOCUMENTS

| | | | | |
|---|---|---|---|---|
| 3,876,895 | A * | 4/1975 | Lake et al. | 313/572 |
| 4,742,268 | A | 5/1988 | Caruso et al. | |
| 5,694,002 | A | 12/1997 | Krasko et al. | |
| 2003/0015949 | A1 * | 1/2003 | Higashi et al. | 313/17 |
| 2003/0141818 | A1 | 7/2003 | Kelly | |

FOREIGN PATENT DOCUMENTS

| | | | |
|---|---|---|---|
| GB | 1 316 803 | | 5/1973 |
| JP | 55133743 | A * | 10/1980 |

* cited by examiner

*Primary Examiner*—Nimeshkumar D. Patel
*Assistant Examiner*—Jose M Diaz

(57) ABSTRACT

A metal halide fill for forming an ionizable fill comprises at least one inert gas, mercury and metal halides, comprising the constituents Na halide, Tl halide, Ca halide and halides of the rare earths. It also comprises Pb halide. This fill may be present in particular in the discharge vessel of a metal halide lamp which has an outer bulb.

3 Claims, 2 Drawing Sheets

METAL HALIDE LAMP WITH FILL COMPRISING LEAD HALIDE

TECHNICAL FIELD

The invention is based on a metal halide lamp having an ionizable fill comprising at least one inert gas, mercury and metal halides, comprising at least one halogen, the fill comprising Ca and at least one rare earth as metals for halides. It deals in particular with fills for lamps with a warm-white luminous color.

BACKGROUND ART

To achieve warm-white luminous colors, U.S. Pat. No. 5,694,002 has disclosed a metal halide discharge lamp which contains a metal halide fill comprising the metals Na, Sc, Li, Dy and Tl with a warm-white luminous color. The color temperature is 3000 K.

Fills of this type comprising scandium have a poor maintenance, which means that the luminous flux drops considerably during the operating time. Moreover, the color rendering of scandium-based lamps is relatively poor, in particular in the red spectral region.

GB 1 316 803 has disclosed a metal halide lamp which uses a metal halide fill which as emitter uses one of the iodides of Tl, Sc, Ca, Cs, Dy, Na, Sn, La, Li and Ba. The buffer gas used is one of the metal iodides of Sb, As, Bi, In, Zn, Cd or Pb. The buffer gas is used in particular to set the electrical properties of the discharge. By contrast, there is no discussion of the buffer gases influencing the color rendering. Only fills comprising the buffer gases ZnI2 and CdI2 are specifically presented. In an exemplary embodiment comprising ZnI2 as buffer gas, optional small quantities of mercury are also taken into consideration as a second buffer gas.

US-A 2003/0141818 makes use of fills comprising halides of Ca and complex-forming halides of Al and/or Ga to improve the red rendering in lamps with color temperatures below 4000 K. Further components, in addition to mercury and noble gas, are halides of Dy, Ho, Tm, Na, Li, Cs.

U.S. Pat. No. 4,742,268 uses fills comprising Ca iodide, thallium iodide and Sn iodide in elliptically shaped discharge vessels made from quartz glass in order to achieve a very good color rendering.

DISCLOSURE OF THE INVENTION

It is an object of the present invention to provide a metal halide fill for metal halide discharge lamp having an ionizable fill comprising at least one inert gas, mercury and metal halides, comprising at least one halogen, the fill comprising Ca and at least one rare earth as metals for halides, which lamp has a particularly good color rendering, in particular including in the red spectral region.

This object is achieved by the following features:

the fill additionally also comprises Pb halide.

Particularly advantageous configurations are given in the dependent claims.

The invention uses a metal halide fill which, in addition to Ca and rare earths, additionally uses Pb halide. Further components may also be present as further halides, in particular of Na and/or Tl. The halogen used is iodine and/or bromine. The rare earths used are preferably at least one of the elements Dy, Ho and Tm, in particular all three simultaneously.

The fill preferably contains large quantities of CaI2, in particular 15 to 50 mol %. Preference is given to a fill which also contains halides, preferably iodides, of rare earths (RE), sodium and thallium. A significant improvement to the red rendering at low color temperatures, preferably below 4000 K, in particular between 2500 and 3500 K, however, only results from the addition of small quantities of PbI2. Lithium and/or Cs may optionally also be added.

Recommended RE elements are Dy and/or Ho and/or Tm, and in particular a mixture of all three is used. The halogen used is iodine or bromine. It is preferable for the fill to contain more iodine than bromine. In particular, iodine alone is used, with a bromine level of at most 10%, on a molar basis.

It is preferable for the composition of the fill to be as follows: in addition to large quantities of Hg (typically 5 to 15 mg per $cm^3$), acting as buffer gas, the light-emitting fill has the following composition:

| | |
|---|---|
| Ca iodide (CaI2) | 15 to 72 mol %, in particular up to 50 mol %; |
| RE iodide (REI3) | 3 to 26 mol %, in particular 5.5 to 15 mol %; |
| Pb iodide (PbI2) | 2 to 5 mol %, in particular 2.4 to 3.6 mol %. |

All these components are required. In addition, it is optionally also possible to add:

| | |
|---|---|
| Na iodide (NaI) | 0 to 70 mol %, in particular 20 to 48 mol %; |
| Tl iodide (TlI) | 0 to 15 mol %, in particular at least 3 mol %; preferably 6 to 11 mol %; |

Further optional components in smaller quantities, for example 0.5 to 2 mol %, are in particular Li iodide and Cs iodide.

The addition of lead iodide is responsible for lowering the color temperature compared to a similar fill without lead iodide. This lowering of the color temperature is of the order of magnitude of 200 to 1000 K, depending on the quantity of lead iodide. At the same time, the R9 is raised by approximately 10 to 40 points.

The fill is suitable in particular when using ceramic discharge vessels, in which context it can equally be used for cylindrical and convex shapes. Typical efficiencies of more than 70 lm/W are achieved. The Ra is greater than 90, the color temperature is of the order of magnitude of 3000 K (a value of between 2800 and 3100 K is typical). The R9 is greater than 60.

The effect observed cannot be explained by simple addition of the spectral fractions of the filling partners. Therefore, lead iodide has hitherto been considered not so much as an emitter but more as a buffer gas.

In general, to lower the color temperature while at the same time improving the red rendering, it is expedient for the emission above 610 nm to be boosted, in particular in the region around 630 nm, and/or for the emission between 490 and 610 nm to be attenuated, in particular around 580 nm.

Given a careful choice of fill, the addition of lead iodide even allows both effects to be achieved simultaneously. In the presence of Ca halide, lead iodide leads to increased emission above 610 nm, in particular in the range of the CaI2 molecular bands between 620 and 660 nm. However, it is also possible to achieve reduced emission below 610 nm, in particular in the region of the resonance lines of Na (590 nm) and Tl (535 nm). A number of mechanisms are possible causes of the changes observed in the spectrum, in particular complex forming, as is already known in prototype form with Na—Sn fills. In particular, the emission of the optically thin Ca lines and CaI2 molecular bands profits from complex forming in the Ca—Pb system. The addition of the strongly vaporizing PbI2 also leads, via dissociation/recombination processes of the molecules, to a constricted temperature profile. This improves the radiation emission conditions of the molecules and impedes radiation emission of the atom resonance lines. Finally, the absorption of PbI2 molecules, which rises in the short-wave direction, may be involved as a third mechanism.

The novel fill is preferably suitable for general illumination purposes for lamps with a rated power of from 50 to 1000 W. It is therefore used for low to medium luminous densities. Here, the wall loading is typically less than 40 W/cm$^2$ and the specific power less than 30 W/mm arc length.

The service life is not adversely affected by the addition of small quantities of lead iodide. The corrosion to the electrode and the electrode vessel are reduced.

BRIEF DESCRIPTION OF THE DRAWINGS

The invention is to be explained in more detail below on the basis of a plurality of exemplary embodiments. In the drawing.

BEST MODE FOR CARRYING OUT THE INVENTION

Figure 1:
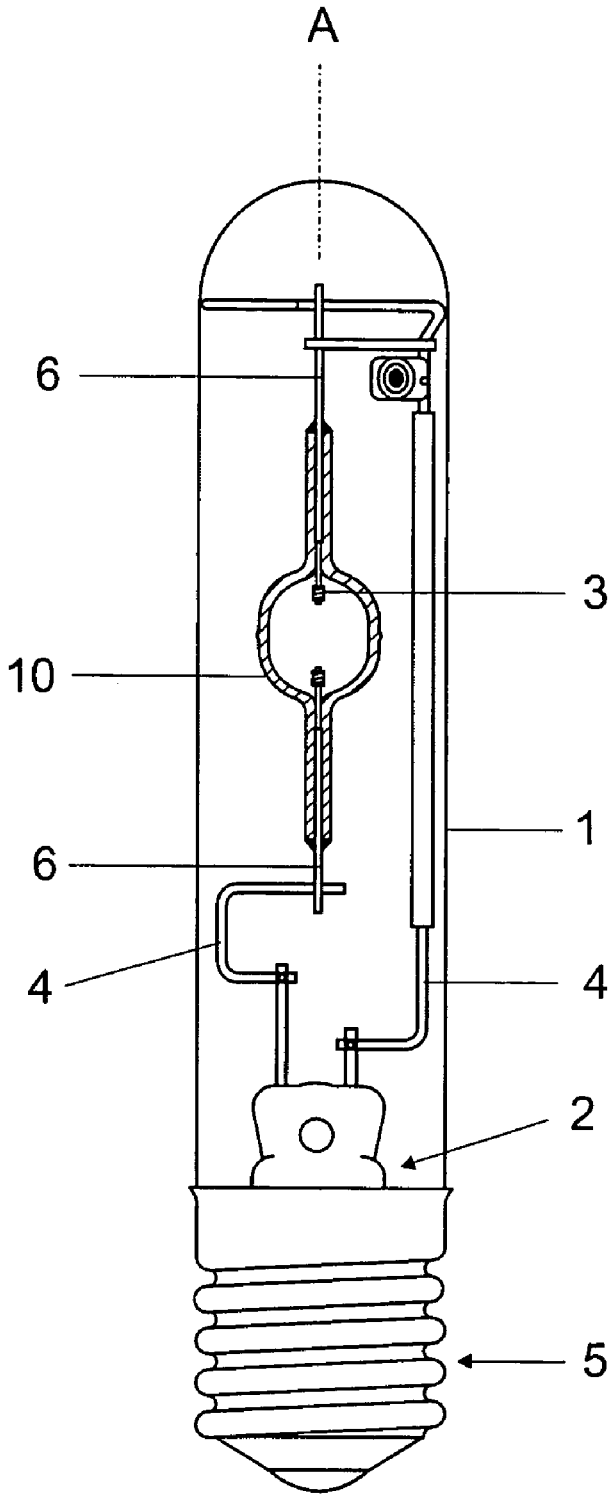
FIG. 1 shows a metal halide lamp according to the invention.

FIG. 1 shows a metal halide lamp having an outer bulb 1 made from hard glass or quartz glass which has a longitudinal axis and is closed off on one side by a fused plate seal 2. Two supply conductors lead out (not shown) at the fused plate seal 2. They end in a cap 5. A ceramic convex discharge vessel 10 made from $Al_2O_3$, which is sealed on two sides and has a fill comprising metal halides, is fitted axially in the outer bulb. Electrodes 3, which are connected to internal supply conductors 4 via leadthroughs 6, project into the discharge vessel.

The power of the lamp is 70 W and the color temperature is 2900 K.

The discharge vessel 10 may in particular be internally spherical or elliptical, or alternatively it may be a deviation from the spherical geometry by virtue of a short cylindrical centerpiece between the half-shells of the sphere. It in particular has the dimensions described in EP-A 841 687.

The contour of the inner wall is, for example, as follows:

the contour has a substantially straight cylindrical center part of a length L and inner radius R as well as two substantially hemispherical end pieces of the same radius R, the length of the cylindrical center part is less than or equal to its inner radius:

$$L \leqq R,$$

the inner length of the discharge vessel is at least 10% greater than the electrode-to-electrode distance EA:

$$2R+L \geqq 1.1EA,$$

the diameter (2R) of the discharge vessel corresponds to at least 80% of the electrode-to-electrode distance EA; at the same time, it must have a length of at most 150% of the electrode-to-electrode distance EA:

$$1.5EA \geqq 2R \geqq 0.8EA.$$

In specific terms here, by way of example, L=1.95 mm, R=3.95 mm and EA=7.4 mm.

An ignitable gas selected from the group consisting of the noble gases is located in the discharge vessel at a cold filling pressure of approximately 300 mbar. The discharge vessel, which has a discharge volume of 0.35 ml, also contains 5.4 mg of mercury and a mixture of metal halides (7.5 mg), consisting of the molar compositions (mol %) according to the following table:

| | NaI | TlI | TmI3 | DyI3 | HoI3 | CaI2 | PbI2 |
|---|---|---|---|---|---|---|---|
| Exemplary embodiment AB1: | 42 | 8 | 1.5 | 1.5 | 1.5 | 42.5 | 3.0 |
| Exemplary embodiment AB2: | 37.5 | 8 | 1 | 1 | 1 | 49 | 2.5 |
| Reference: | 34 | 9 | 1.4 | 1.3 | 1.3 | 53 | 0.0 |

The power consumed is typically in a range from 50 to 400 W. The Ra of these lamps AB1 and AB2 is typically 93, and the R9 is 67.

In the lamps tested, Pb halide does not act as a buffer, since it has no significant influence on the electrical resistance and does not affect the operating voltage. Rather, it manifests itself as a component which influences the emission properties. This is less due to direct emission as a line or band of its own, but rather as a result of influencing the emission of the other metal halides, in particular of Ca, but also of Na and Tl.

Figure 2:
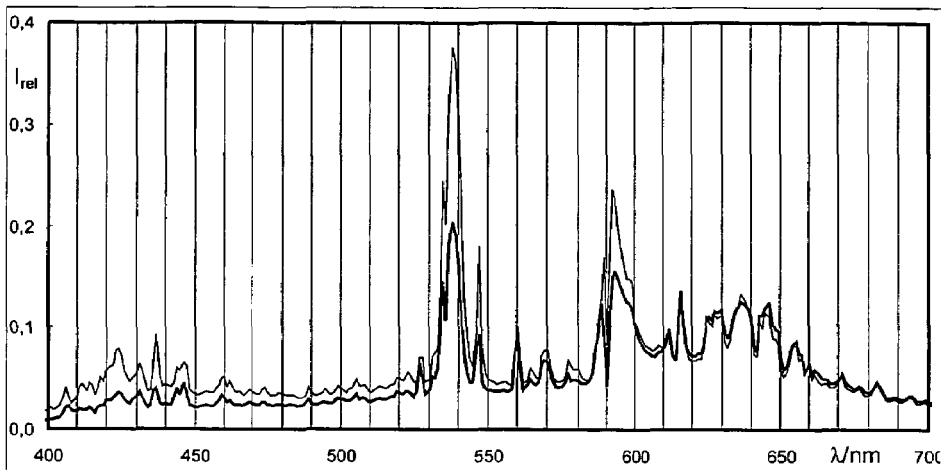
FIG. 2 shows a spectrum of this lamp.

FIG. 2 shows the spectrum of lamps with an operating time of 100 h in accordance with the exemplary embodiment AB1, the discharge vessel of which contains 5.4 mg of Hg and 7.5 mg of metal halide fill in accordance with Table 1. It is compared with the spectrum of the reference from Table 1. A significant rise in the red spectral region and a drop in the intensity of the short-wave emission in the range from 400 to 600 nm can be recognized. The lead-containing fill is printed in bold and the reference as a normal-thickness solid line.

Figure 3:
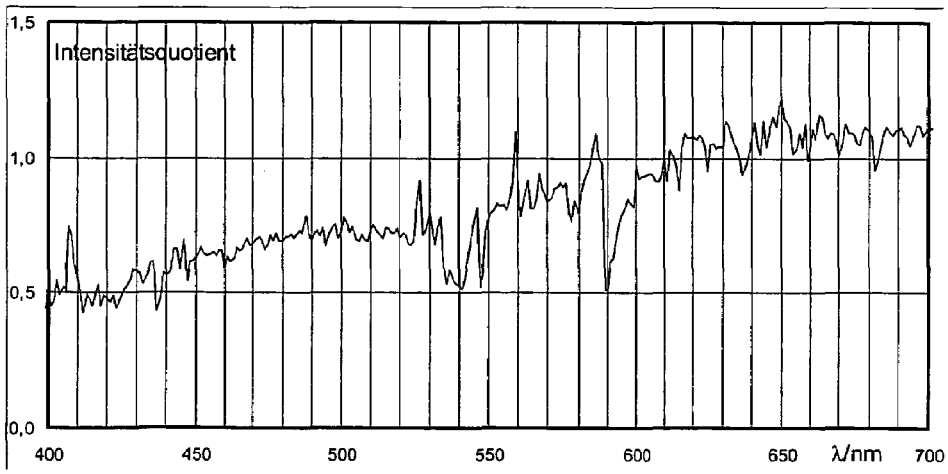
FIG. 3 shows the change in the spectrum compared to fills without the addition of PbI2.

To illustrate the influence of the lead iodide on the spectrum, FIG. 3 plots the quotient of the intensities AB1:ref. This reveals a rise in the red spectral region and a drop in the intensity of the short-wave emission in the range from 400 to 600 nm, in particular in the range of the resonance lines of Na and Tl around 590 and 540 nm, respectively.

A higher or lower color temperature can be set by selecting the relative ratios of the metal halides. As rare earths, the fill in each case uses Tm, Dy and Ho, preferably in approximately equal proportions. These proportions may vary, in particular in a ratio up to at most three times the component with the lowest representation, i.e. up to 3:3:1. However, depending on the desired result, it is also possible to use only one or two rare earths, for example only Dy.

What is claimed is:

1. A metal halide lamp having an ionizable fill comprising at least one inert gas, mercury and metal halides, comprising at least one halogen, the fill comprising Ca and at least one rare earth as metals for halides, wherein the fill additionally also comprises Pb halide, wherein the fill uses the following fractions:

| | |
|---|---|
| Ca iodide $CaI_2$ | 15 to 72 mol % |
| Rare Earth metal (RE) iodide $REI_3$ | 3 to 26 mol % |
| Pb iodide $PbI_2$ | 2 to 5 mol %. |

2. A metal halide lamp having an ionizable fill comprising at least one inert gas, mercury and metal halides, comprising at least one halogen, the fill comprising Ca and at least one rare earth as metals for halides, wherein the fill additionally also comprises Pb halide, wherein the fill additionally comprises at least one halide of the metals Tl, Na, wherein the fill uses the following fractions:

| | |
|---|---|
| Ca iodide $CaI_2$ | 15 to 50 mol % |
| Na iodide (NaI) | 20 to 70 mol % |

-continued

| | |
|---|---|
| Tl iodide (TlI) | 3 to 15 mol % |
| Rare Earth metal (RE) iodide $REI_3$ | 3 to 15 mol % |
| Pb iodide $PbI_2$ | 2 to 5 mol %. |

3. The metal halide lamp as claimed in claim 2, wherein Pb iodide $PbI_2$ is used in the following fraction: 2.4 to 3.6 mol %.

* * * * *